US005233822A

United States Patent [19]

Ward et al.

[11] Patent Number: 5,233,822

[45] Date of Patent: Aug. 10, 1993

[54] METHOD AND SYSTEM FOR THE DISASSEMBLY OF AN ANNULAR COMBUSTOR

[75] Inventors: Steven D. Ward, Cincinnati; Harold R. Hansel, Mason, both of Ohio

[73] Assignee: General Electric Company, Cincinnati, Ohio

[21] Appl. No.: 648,769

[22] Filed: Jan. 31, 1991

[51] Int. Cl.[5] ..... F02G 3/00; F02C 7/20

[52] U.S. Cl. ..... 60/39.02; 60/39.31; 60/39.37

[58] Field of Search ..... 60/39.31, 39.33, 39.37, 60/39.02; 431/353

[56] References Cited

U.S. PATENT DOCUMENTS

| | | | |
|---|---|---|---|
| 3,035,410 | 5/1962 | Foulon | 60/39.31 |
| 3,657,883 | 4/1972 | De Corso | 60/39.31 |
| 4,720,970 | 1/1988 | Hudson et al. | 60/39.37 |
| 4,825,648 | 5/1989 | Adamson | 60/39.31 |

FOREIGN PATENT DOCUMENTS 1001770 12/1949 France .

OTHER PUBLICATIONS

"General Electric Heavy-Duty Gas Turbines 5001", Nov. 1976, p. 6, (publication GEA-8501A).

*Primary Examiner*—Richard A. Bertsch
*Assistant Examiner*—Howard R. Richman
*Attorney, Agent, or Firm*—Jerome C. Squillaro; James P. Davidson

[57] ABSTRACT

An apparatus and method for effecting the disassembly of an annular combustor for the maintenance of very large power generation gas generators such as those used in military aircraft engines, commercial aircraft engines, and smaller power generation turbines. The apparatus utilizes rollers which are attachable to a lower half outer casing. An inversion ring located radially inward from the lower half outer casing is supported by the rollers. By disconnecting a removable upper half outer casing, the combustor segments of a first section of the combustor can be removed. Supports connected to the first section of the combustor are secured by pins to a tool ring which is in turn secured to the inversion ring so as to create a closed path. By removing pins which secure the inversion ring and lower half outer casing to supports connected to a second section of combustor segments, the combustor can be rotated so that the second section of formerly inaccessible segments can be easily removed.

10 Claims, 5 Drawing Sheets

METHOD AND SYSTEM FOR THE DISASSEMBLY OF AN ANNULAR COMBUSTOR

BACKGROUND OF THE INVENTION

1. Field of the Invention

The present invention relates to power generation gas generators such as those used in military aircraft, commercial aircraft, and power generating turbines. More particularly, the present invention pertains to a method and apparatus for the easy disassembly and reassembly of an annular combustor in such generators.

2. Discussion of the Background

To briefly summarize, gas turbine engines are comprised of compressor, combustor, and turbine sections. The compressor compresses ambient air which enters the engine. A combustor or combustor chamber located between the compressor and turbine sections of the engine receives this pressurized air through diffusion vanes. Fuel is mixed with this pressurized air, and the fuel and air mixture is ignited in the combustion chamber to produce a high energy gas stream which is expelled to the turbine. The high energy gas stream turns the turbine blades which are mechanically connected to a shaft. The shaft is connected to the rotor of the compressor and axially extends below the combustor before connecting to the turbine.

U.S. Pat. No. 3,842,595 to Smith et al., herein incorporated by reference, provides an exemplary description of a gas turbine engine.

Traditionally large power generation gas generators have utilized combustors of the can or can/annular design as a result of maintenance concerns. Although annular combustors provide added benefits in performance, size, and emissions, they have been most difficult to maintain. The maintenance of an annular combustor typically necessitates completely disassembling the turbine or breaking the shaft between the turbine and compressor to remove or repair the combustor. Such an arduous procedure has been necessary due to the fact that access to annular combustors is typically limited to an accessible half (e.g., the upper half) of the combustors. Access to the lower half of annular combustors is accomplished only upon the completion of the aforementioned disassembly. Of course, such an involved disassembly increases the chances that an error will occur when the apparatus is reassembled and greatly increases the out-of-service time of the engine for such maintenance or repair.

Thus, a need is seen to exist for a method and apparatus which would allow for the maintenance of an annular combustor by providing access to the upper and lower halves of the combustor without disassembling the turbine or compressor from the engine.

SUMMARY OF THE INVENTION

Accordingly, one object of the invention is to provide a system for simplified maintenance of an annular combustor.

Another object of the present invention is to provide a method for the maintenance and removal of an annular combustor without the need for tampering with the other components of the power generation gas generator while allowing for the complete removal of the combustor when only partial access to the combustor region is afforded.

Briefly, these and other objects of the present invention are accomplished by providing an annular combustor with a removable upper half outer casing which is proximate to an accessible section of combustor pieces and segments. The removable casing is secured to a split flange by means of bolts. A lower outer half casing is permanently affixed to the split flange, the permanent outer casing being proximate to an inaccessible section of combustor segments.

An inversion ring is positioned radially inward from the permanent outer casing and is secured thereto. Both the accessible and inaccessible sections of combustor segments are provided with supports which are affixed to the combustor liner at various locations along the circumference of the combustor. These supports can be secured to particular locations of the outer casing and inversion ring by means of pins which are designed to fit into the supports.

After removal of the fuel nozzles and manifolds, disassembly of the annular combustor is accomplished by removing the removable casing to expose the accessible combustor segments and attaching rollers at selected locations along the permanent outer casing to support the inversion ring and combustor. After removing the accessible combustor segments, elongated supports are connected to the combustor liner in the accessible section of the combustor. The elongated supports are used to join the combustor liner to a tool ring. The tool ring is fastened to the inversion ring by a securing mechanism so as to create a closed circular path with the lower half combustor coupled to the inversion ring and with the inversion ring supported on rollers fixed to the lower half casing.

The aft end portion of the combustor is provided with a pair of tongues which mate with corresponding groove joints in the turbine stator assembly. The tongue and groove joints allow the combustor to be rotated without affecting the turbine stator. The combustor is therefore rotatable with respect to the engine by releasing the securing pins from the permanent outer casing. After rotating the combustor so that the tool ring is located in the former location of the inversion ring, the inversion ring can be removed so as to gain access to the previously inaccessible combustor segments. After all the combustor segments have been removed, they can be easily replaced by reversing the above-described process.

BRIEF DESCRIPTION OF THE DRAWINGS

For a better understanding of the present invention and many of the attended advantages thereof, reference is made to the following detailed description taken in conjunction with the accompanying drawings in which.

DETAILED DESCRIPTION OF THE INVENTION

Figure 1:
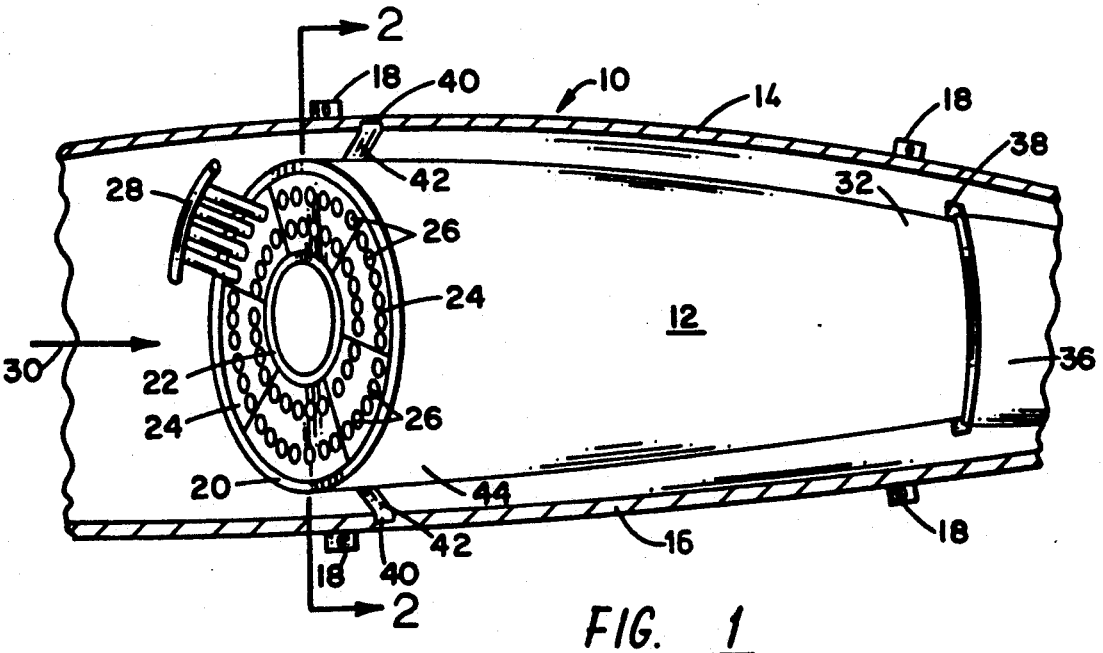
FIG. 1 is a simplified, partial axial perspective view of a gas turbine engine incorporating the teaching of the present invention in which an annular combustor is shown in relation to a lower half permanent outer casing.

Reference is now made to the drawings wherein like reference numerals designate identical or corresponding parts through the respective figures and more particularly to FIG. 1 and the simplified, partial view of the gas generator 10. Annular combustor 12, which is a part of and performs the combustion function for gas generator 10, is positioned within lower half outer casing 16. Combustor 12 is comprised of an outer combustor liner 20 which is spaced radially outward of an inner combustor liner 22.

Between inner combustor liner 22 and outer combustor liner 20, at the front end portion of combustor 12, are located combustor segments 24 which house fuel cups 26. Fuel cups 26 receive fuel by way of fuel nozzles 28, only one of which is shown. Fuel and compressed air, indicated by arrow 30 from the compressor (not shown), are received at the front end of the combustor 12. A high energy gas stream is directed to the aft end portion 32 of the combustor 12 where the gas stream is directed into a turbine section 36. Recessed in a grooved channel 40 of the lower half outer casing 16 and removed from the air path into the combustor is an inversion ring 42 which forms a half circle around the lower half of the combustor's forward end 44.

Figure 2:
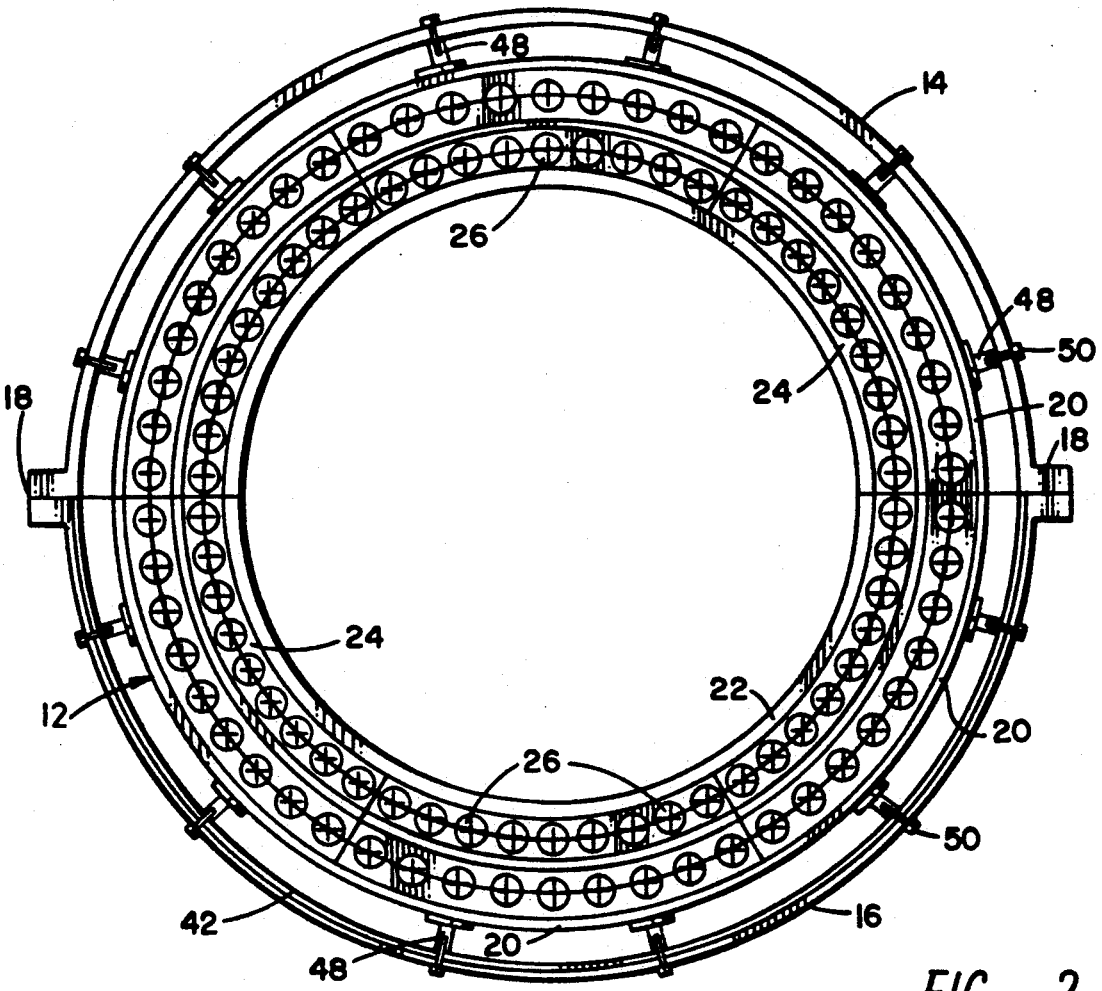
FIG. 2 is a sectional front view taken along line 2—2 of FIG. 1 and includes an upper half removable outer casing.

With reference to FIG. 2, upper half outer casing 14 is secured to lower half outer casing 16 to form a casing which completely encloses combustor 12. Upper half outer casing 14 and lower half outer casing 16 are connected by means of split flanges 18. Supports 48 connected to the outer combustor liner 20 are used to secure the combustor 12 to the outer casing represented by the upper half outer casing 14 and the lower half outer casing 16. Upper half outer casing 14, lower half outer casing 16, and inversion ring 42 are equipped with threaded holes which allow pins 50 to be inserted therethrough and into supports 48. The supports 48 and pins 50 support the combustor 12 in spaced relationship from casings 14, 16. Each support 48 connected to the upper half outer casing 14 has a corresponding support located 180 degrees away which connects to the inversion ring 42 and lower half outer casing 16.

Figure 3:
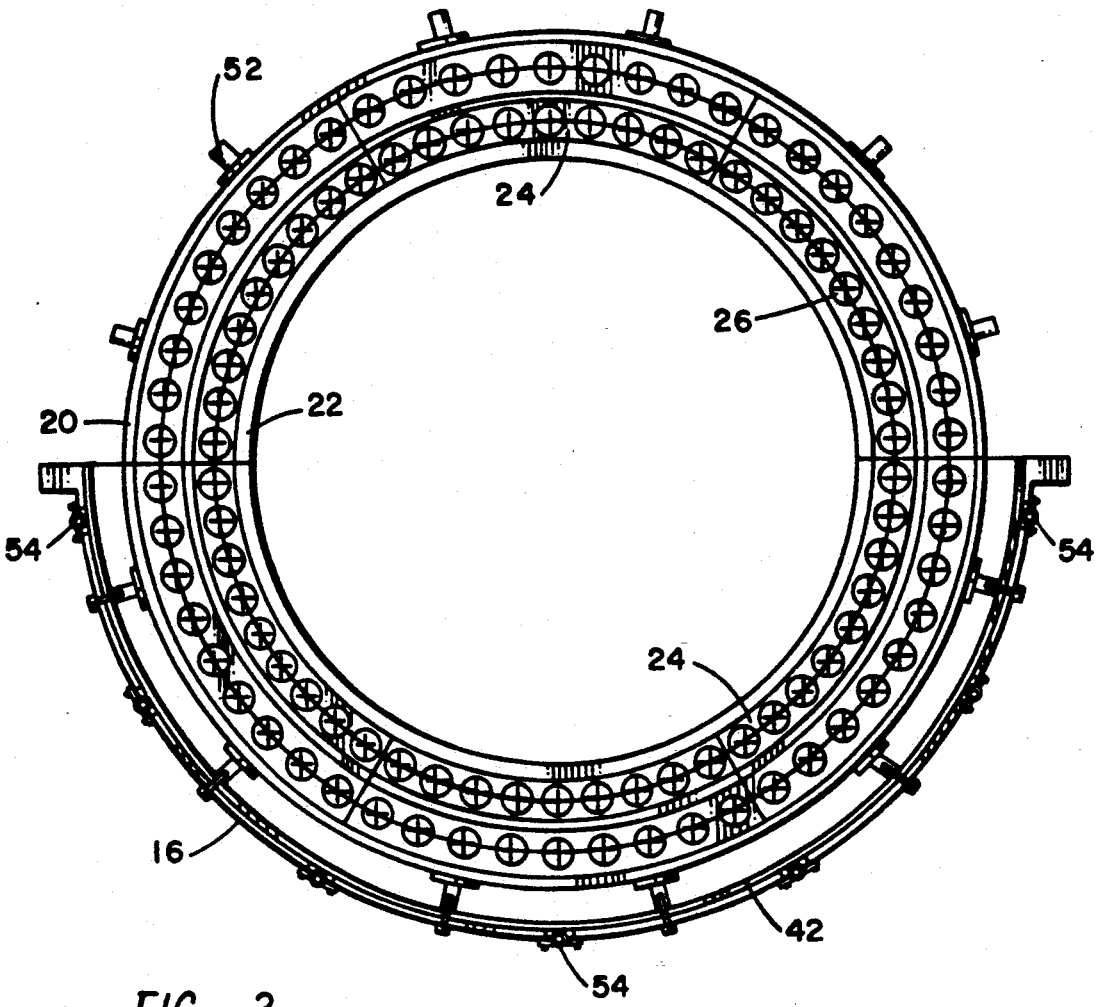
FIG. 3 is similar to FIG. 2, but with the upper half outer casing removed and rollers attached to the lower half outer casing.
Figure 4A:
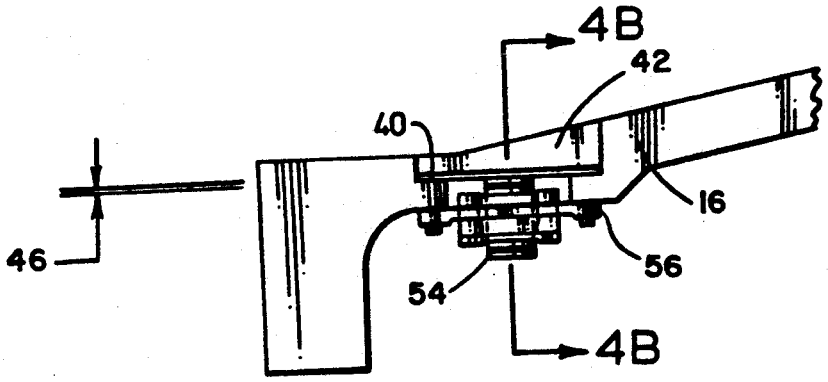
FIG. 4A is a perspective illustration showing how the rollers of the present invention are attached to the lower half outer casing.
Figure 4B:
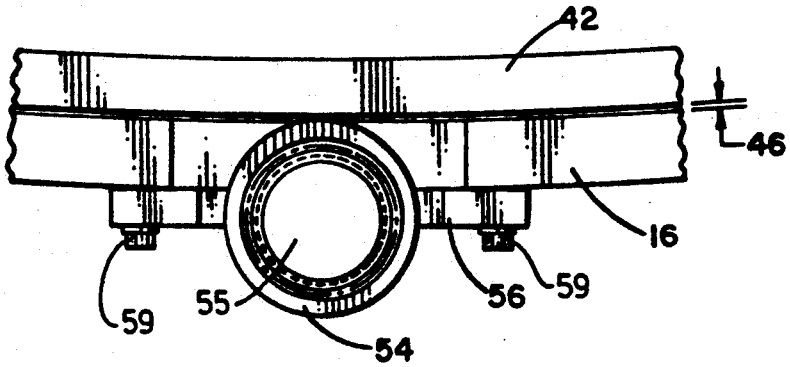
FIG. 4B is a sectional view taken along line 4—4 of FIG. 4A illustrating how the rollers of the present invention contact and support the inversion ring of the present invention.

FIG. 3 is an axial view of the combustor section corresponding to FIG. 1 in which the upper half outer casing has been removed to expose the top half of combustor segments 24. Connected to the lower half outer casing 16 and engaging inversion ring 42 are rollers 54. The rollers 54 are best seen in FIGS. 4A and 4B; however, before turning to those figures, it will be noted that the rollers 54 are not installed on an operating gas generator but are only used during the combustor disassembly/assembly process. The casing 16 is provided with apertures through which rollers 54 protrude so as to contact inversion ring 42 and support it spaced from the casing 16 when the rollers are in their assembled position. The rollers 54 are mounted via axles 55 to support plate 56. The plate 56 is provided with apertures (not shown) through which bolts 59 pass for bolting the plate 56 to casing 16 to hold rollers 54 in the assembled position. With reference to FIG. 4A, inversion ring 42 is positioned in grooved channel 40 of lower half outer casing 16. The inversion ring 42 can be seen to be supported from lower half outer casing 16 by a clearance 46 of about two millimeters, thus allowing the inversion ring to be rotated on rollers 54 without frictionally engaging casing 16. FIG. 4B, taken along line B—B of FIG. 4A, shows roller support plate 56 connected to lower half outer casing 16 by bolts 59 so that the roller 54 rotatably supports inversion ring 42.

Figure 5:
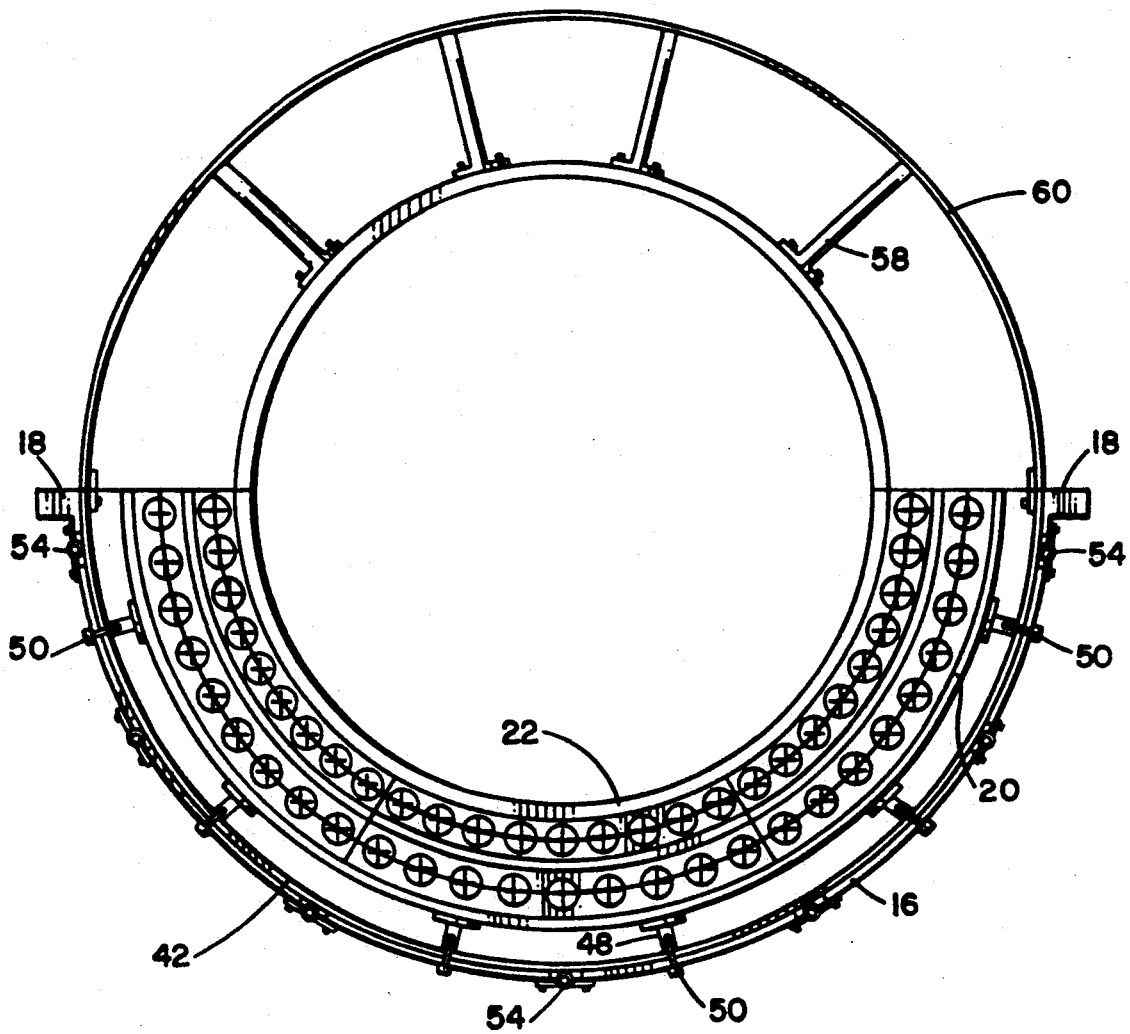
FIG. 5 is similar to FIG. 3, but with the upper half combustor segments removed and the tool ring of the present invention attached to the inversion ring.
Figure 6:
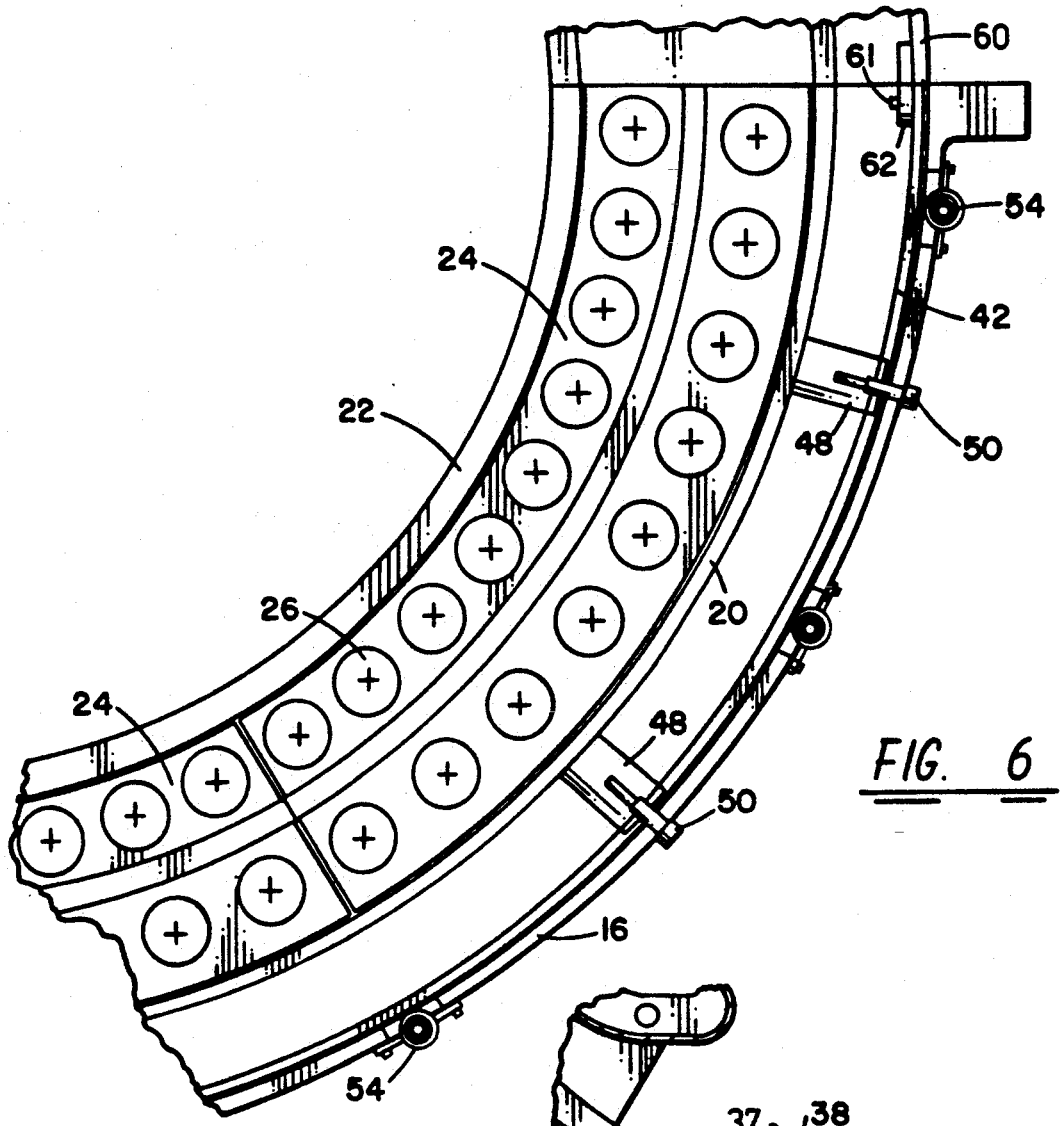
FIG. 6 is a close-up view of the lower right quadrant of FIG. 5.

Turning now to FIG. 5, the upper half of the outer combustor liner 20 and the upper half of the combustor segments 24 (as shown in FIG. 3) have been removed. A plurality of elongated supports 58 are connected to the upper half of the inner combustor liner 22 and support a tool half ring piece (tool ring) 60 which is substantially identical to inversion ring 42. The tool ring 60 is connected to the inversion ring 42 so as to form a 360 degree ring encircling the combustor 12. As shown in the enlarged partial sectional view of FIG. 6, the tool ring 60 is coupled to the inversion ring 42 by a radially inner mounted plate 62 to provide a continuous radially outer surface for riding on rollers 54. The plate 62 may be welded to tool ring 60 and be bolted to inversion ring 42 as shown by bolt 61.

Figure 7:
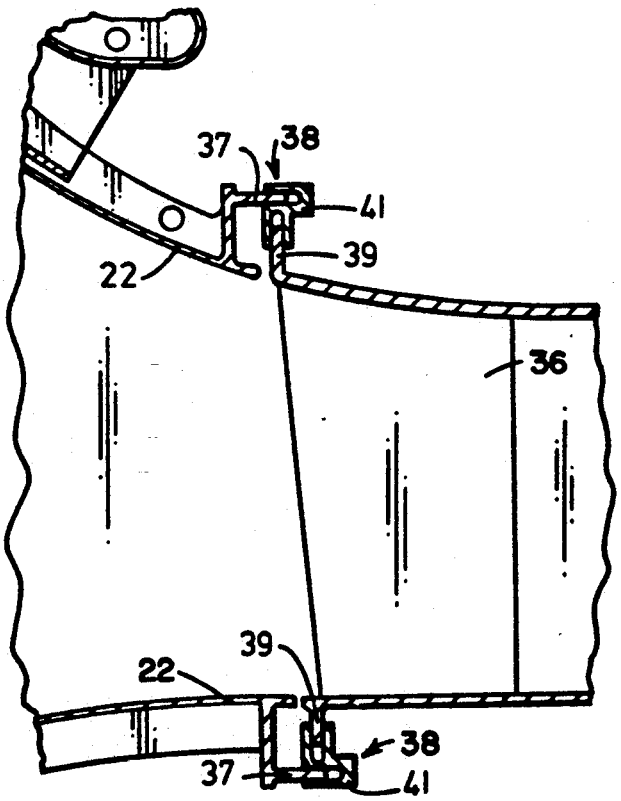
FIG. 7 is a side view of the tongue and groove joints of the present invention.

It will be appreciated that the assembled tool ring 60 and inversion ring 42 provide a means for rotating the combustor 12 within the casing 16. The forward end of the combustor 12 is not physically connected to the compressor stage and is thus free to rotate with respect to the compressor. However, the aft end 32 of the combustor 12 is coupled to the turbine stage 36 in order to prevent leakage of combustion gases. Referring to FIG. 7, there is shown an enlarged view of a rotatable coupling between the combustor and turbine stage.

Coupling is accomplished by a pair of annular tongue and groove joints at 38 which allow the combustor to thermally expand without detrimentally affecting the turbine stage as the temperatures present in the combustor are often greatly in excess of those temperatures experienced by the turbine section. The combustor 12 and turbine 36 each include a tongue 37, 39, respectively, which fit into grooves in an annular joining ring designated 41. The tongue and groove joints have the additional purpose of being a means by which the combustor can be easily disconnected from the turbine assembly. As can be seen, when the combustor 12 is rotated, tongues 37 slide within their respective grooves.

Figure 8:
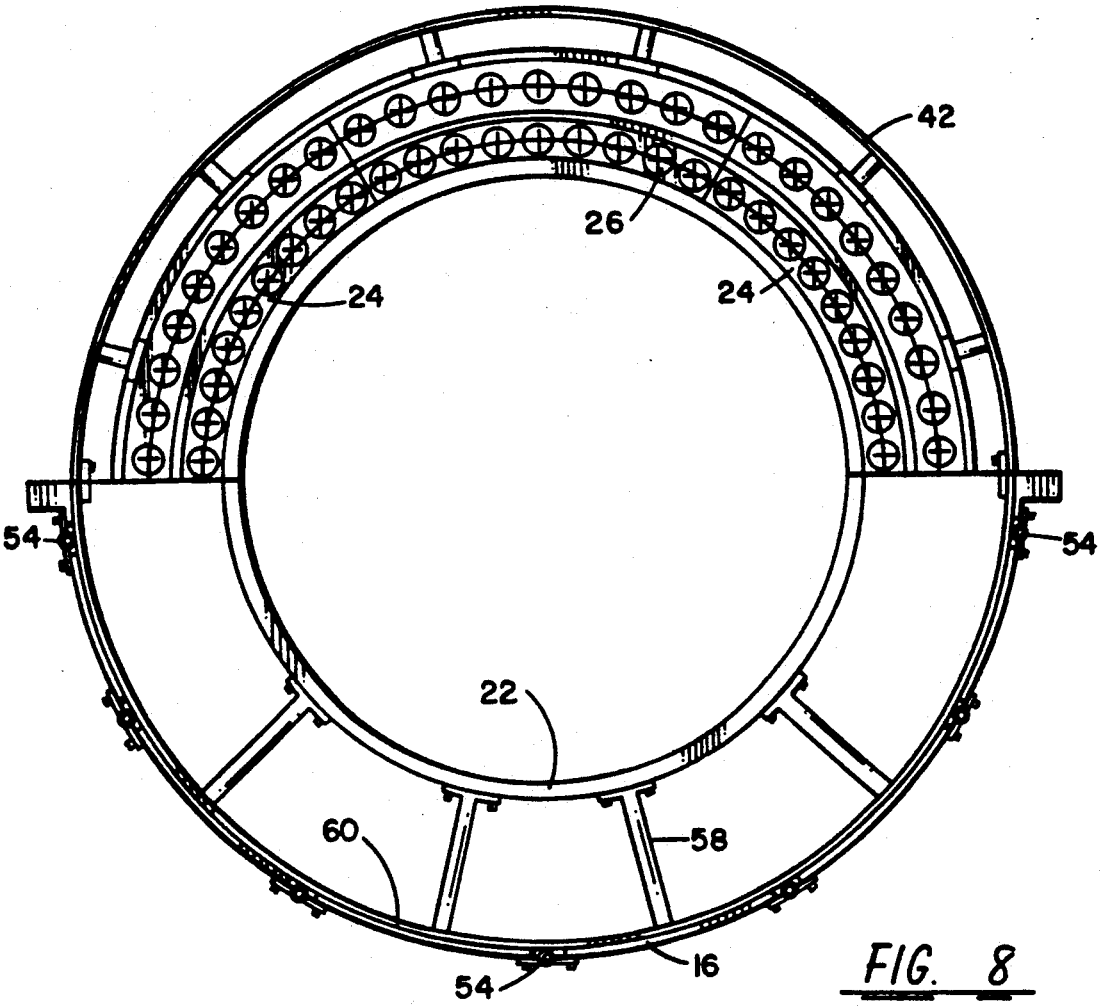
FIG. 8 is similar to FIG. 6, but differs in that the lower half combustor segments have been rotated to appear in the top half of the circle formed by the inversion ring and tool ring of the present invention.

In FIG. 8, inversion ring 42 and tool ring 60 have been rotated 180 degrees as compared to FIG. 5 so that each is in the other's former respective position. The combustor segments which appeared in the lower half of FIG. 5 are positioned in the upper half of FIG. 8. In this position, the inversion ring 42 can be removed allowing access to the underlying combustor segments.

Figure 9:
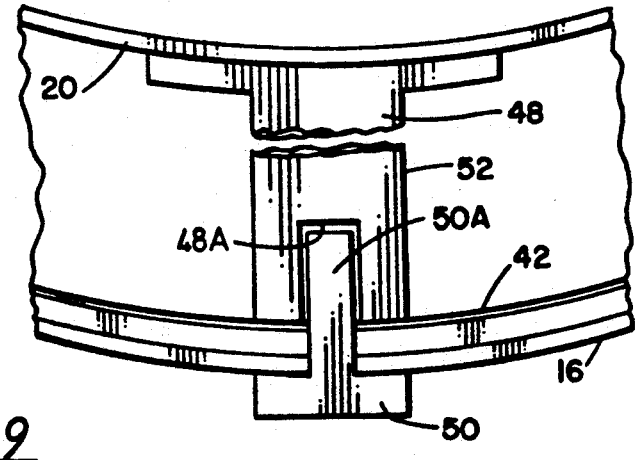
FIG. 9 is a close-up perspective view of the support and pin securing mechanism of the present invention.

With reference to FIG. 9, there is shown an enlarged view of a pin 50 and a support 48 for supporting the combustor 12 in spaced relationship to casings 14, 16. The support 48 may be welded or otherwise attached to the outer combustor liner 20. Support 48 includes an aperture 48A in which the shafts 50A of pins 50 slide, i.e., the pins 50 slidably engage the support 48 to accommodate differential thermal expansion of combustor 12 and casings 14, 16.

The present invention allows for the easy maintenance of annular combustors located in power generation gas generators. When maintenance or repair is desired, the upper half outer casing 14 is removed by disconnecting upper half outer casing 14 from lower half outer casing 16 at split flange 18 and by removing the pins 50 which make contact with outer half casing 16. This being accomplished, the upper half outer casing 14 is removed and the manifolds 28 and associated fuel nozzles (not shown) are removed to provide access to the accessible combustor segments 24 located in the top portion of the combustor. The accessible combustor segments 24 are then removed along with the accessible fuel cups 26.

Rollers 54 are bolted to lower half outer casing 16 to support inversion ring 42 for rotation with respect to casing 16. With the combustor segments 24 removed from the upper half of the combustor and the upper half of the outer combustor liner 20 removed, elongated supports 58 are attached to the inner combustor liner 22 (FIG. 5). These elongated supports 58 support tool half ring 60 which ring 60 is connectable to inversion ring 42 and joined thereto by securing mechanism 62. Inversion ring 42 and tool ring 60 are thus joined to form a closed circular path.

The rollers 54 having been attached to the lower half outer casing 16 and the tool ring 60 and inversion ring 42 having been connected, the pins 50 are then removed from the lower half outer casing 16. The combustor 12, at this point, is supported by the inversion ring 42 which is in turn supported on rollers 54. The combustor can be rotated 180 degrees so that the formerly inaccessible lower half of combustor segments 24 are now located in an accessible position opposite the permanent outer casing 16 (FIG. 8). Some of the pins 50 are then inserted into the permanent lower half outer casing 16 to prevent unwanted rotation of the tool ring/inversion ring assembly while the exposed combustor segments are being disassembled or assembled.

Since inversion ring 42, after being rotated 180 degrees, is now in the former location of tool half ring piece 60, inversion ring 42 can be removed to give access to the formerly inaccessible combustor segments. Removal of these formerly inaccessible segments is then easily accomplished.

The reassembling of the annular combustor is achieved by a simple reversal of the above-described process.

The present invention allows for the use of annular type combustors and their concomitant benefits in efficiency and emissions while meeting the assembly/disassembly maintainability requirements of such systems.

The above description is intended to be illustrative and non-limiting. Numerous changes and modifications of the present invention are possible in light of the above teachings. It is therefore to be understood that within the scope of the appended claims, the invention may be practiced otherwise than as specifically described herein.

What is claimed is:

1. A method for the disassembly of an annular combustor in a power generation gas generator having a first section of accessible combustor segments connected to a second section of inaccessible combustor segments within an outer casing, an inversion ring being coupled to the inaccessible combustor segments within a non-removable portion of the outer casing, said method comprising the steps of:

(a) affixing a plurality of rollers to the outer casing surrounding the inaccessible combustor segments;
(b) removing a detachable portion of the outer casing overlaying the accessible combustor segments;
(c) removing the accessible combustor segments;
(d) connecting a tool ring to the inversion ring to form a closed circular path about the combustor;
(e) releasing the inversion ring from the outer casing;
(f) rotating said inversion ring so that the inversion ring exchanges positions with the tool ring;
(g) removing said inversion ring; and
(h) removing said inaccessible combustor segments.

2. The method of claim 1 wherein the inversion ring is supported on rollers at least during the disassembly process and the step of rotating includes rotating the inversion ring and combustor segments on the rollers.

3. The method of claim 1 wherein the inversion ring is fixedly coupled to the outer casing by a plurality of circumferentially spaced pins, the step of releasing including the step of removing the pins to allow rotation of the inversion ring within the outer casing.

4. A power generation gas generator comprising:

an annular combustor having a first section of accessible combustor segments connected to a second section of inaccessible combustor segments; and means for rotating said annular combustor so that said inaccessible combustor segments are rotated to a former location of said accessible combustor segments, said rotating means comprising a tool ring and an inversion ring which are connected to form a closed path around which said annular combustor rotates.

5. A generator according to claim 4 wherein:

said rotating means further comprises rollers connectable to a lower half outer casing surrounding said inaccessible combustor segments for supporting said inversion ring for rotation within said casing.

6. A generator according to claim 3 wherein said means for rotating further comprises:

an annularly oriented tongue and groove joint at the aft end portion of said annular combustor for coupling said annular combustor to a turbine section and permitting relative rotation without disassembly.

7. A system for effecting the disassembly and reassembly of an annular combustor contained in a power generation gas turbine engine, said system comprising:

an inversion ring positioned radially inward from a permanent outer casing;

roller means for supporting said inversion ring, said roller means being attachable to said outer casing; and a tool ring connectable to said inversion ring so as to form a closed path encircling said annular combustor.

8. A system according to claim 7 wherein said annular combustor comprises a first section of accessible combustor segments connected to a second section of inaccessible combustor segments.

9. A system according to claim 8 further comprising:

supporting means connecting said inaccessible combustor segments to said inversion ring and said permanent outer casing.

10. A system according to claim 9 further comprising:

pins for securing said supporting means to said inversion ring and to said permanent outer casing.

* * * * *